US010584489B2

(12) United States Patent
Bergman et al.

(10) Patent No.: US 10,584,489 B2
(45) Date of Patent: Mar. 10, 2020

(54) CEILING SYSTEM AND MOUNTING BRACKET FOR USE WITH THE SAME

(71) Applicant: ARMSTRONG WORLD INDUSTRIES, INC., Lancaster, PA (US)

(72) Inventors: Todd M. Bergman, Lititz, PA (US); Scott D. Harnish, Lancaster, PA (US); Ryan D. Hanuschak, Lancaster, PA (US); Jonathan P. Van Dore, Lititz, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 16/161,275

(22) Filed: Oct. 16, 2018

(65) Prior Publication Data

US 2019/0048588 A1 Feb. 14, 2019

Related U.S. Application Data

(63) Continuation of application No. 15/686,301, filed on Aug. 25, 2017, now Pat. No. 10,100,519.
(Continued)

(51) Int. Cl.
*E04B 2/00* (2006.01)
*E04B 9/30* (2006.01)
(Continued)

(52) U.S. Cl.
CPC ..... *E04B 9/30* (2013.01); *E04B 9/127* (2013.01); *E04B 9/20* (2013.01); *E04B 9/242* (2013.01); *E04B 9/067* (2013.01)

(58) Field of Classification Search
CPC . E04B 9/067; E04B 9/122; E04B 9/00; E04B 9/30; E04B 9/225; E04B 9/04;
(Continued)

(56) References Cited

U.S. PATENT DOCUMENTS 3,003,600 A * 10/1961 MacKenzie ..... A47B 96/1408 403/4
3,350,830 A * 11/1967 Smith, Jr. ..... E04F 13/0855 52/134
(Continued)

FOREIGN PATENT DOCUMENTS

| | | |
|---|---|---|
| JP | 2005-214004 | 8/2005 |
| WO | 2015069612 A1 | 5/2015 |
| WO | 2017040104 A1 | 3/2017 |

OTHER PUBLICATIONS

USG Ceiling Solutions, Extruded Perimeter Trims; and Perimeter Trims. Product Information. Aug. 2017. US.
(Continued)

*Primary Examiner* — Chi Q Nguyen
(74) *Attorney, Agent, or Firm* — Craig M. Sterner

(57) ABSTRACT

A ceiling system having a perimeter frame; a grid configured to support a plurality of substrates; and a plurality of bracket assemblies coupling the grid to the perimeter frame, the plurality of bracket assemblies adjustable between a plurality of states in which the grid is supported at a different height relative to the perimeter frame in each of the plurality of states.

18 Claims, 11 Drawing Sheets

Related U.S. Application Data

(60) Provisional application No. 62/381,204, filed on Aug. 30, 2016.

(51) Int. Cl.
*E04B 9/24* (2006.01)
*E04B 9/12* (2006.01)
*E04B 9/20* (2006.01)
*E04B 9/06* (2006.01)

(58) Field of Classification Search
CPC ... E04B 9/003; E04B 9/16; E04B 9/06; E04B 9/26; E04B 1/40; E04B 2001/405; E04B 9/001; E04B 9/34; E04B 9/27; E04B 9/10; E04B 2009/186; E04B 9/068
USPC ..... 52/506.05, 506.07, 712, 713, 714, 715, 52/474, 501.01, 506.03, 506.08, 506.09, 52/506.1, 507, 655.1; 248/316.7, 221.11, 248/317, 343, 320.1, 222.14
See application file for complete search history.

(56) References Cited

U.S. PATENT DOCUMENTS 4,363,459 A * 12/1982 Holzer ..... E06B 9/323 248/257
5,127,760 A * 7/1992 Brady ..... E04B 2/825 403/230
5,484,076 A 1/1996 Petrushka
5,529,273 A * 6/1996 Benthin ..... A47H 1/142 160/902
5,551,792 A 9/1996 Witmyer
5,572,844 A 11/1996 Stackenwalt et al.
6,213,679 B1 * 4/2001 Frobosilo ..... E04B 2/82 403/14
6,305,139 B1 10/2001 Sauer
6,345,800 B1 2/2002 Herst et al.
7,104,024 B1 * 9/2006 diGirolamo ..... E04B 2/767 403/231
7,788,878 B1 * 9/2010 diGirolamo ..... E04B 2/58 29/897.3
8,413,402 B2 4/2013 Sareyka
8,615,948 B2 12/2013 Underkofler et al.
8,813,457 B2 8/2014 Underkofler et al.
9,045,892 B2 * 6/2015 Smith ..... E04B 1/003
2002/0062617 A1 * 5/2002 diGirolamo ..... E04B 2/767 52/688
2005/0160696 A1 7/2005 Kelly et al.
2006/0096219 A1 5/2006 Ingratta et al.
2009/0235603 A1 9/2009 Bergman
2011/0283634 A1 11/2011 Underkofler et al.
2012/0247059 A1 * 10/2012 Daudet ..... E04B 1/2403 52/705
2013/0180572 A1 7/2013 West
2013/0227908 A1 * 9/2013 Gulbrandsen ..... E04B 9/10 52/665
2014/0000205 A1 1/2014 Underkofler et al.
2016/0102454 A1 4/2016 Lehane et al.
2017/0226736 A1 8/2017 Lehane et al.
2017/0268228 A1 9/2017 Bergman
2018/0066425 A1 * 3/2018 Ralph ..... E04B 1/2403

OTHER PUBLICATIONS

International Search Report for corresponding Application No. PCT/US2017/048562, dated Dec. 4, 2017. WO.

* cited by examiner

CEILING SYSTEM AND MOUNTING BRACKET FOR USE WITH THE SAME

CROSS-REFERENCE TO RELATED APPLICATIONS

This application is a continuation of U.S. application Ser. No. 15/686,301, filed Aug. 25, 2017 (now U.S. Pat. No. 10,100,519), which claims the benefit of U.S. Provisional Application No. 62/381,204, filed on Aug. 30, 2016. The disclosures of the foregoing applications are incorporated herein by reference in their entireties.

BACKGROUND

The present invention generally relates to ceiling systems and mounting brackets for use with the same.

Some ceiling systems, for example grid ceiling systems, can be used with a large variety of ceiling panels or substrates. One variety of these various panels or substrates can have a particular thickness while another variety can have a different thickness. These different thicknesses can result in the need to use different depth perimeter frames and/or different size mounting brackets. Manufacturing many different sizes of this hardware is expensive and requires the maintenance of a large inventory.

BRIEF SUMMARY

The present invention provides a solution to the above described problem of having to use a different mounting bracket for each size ceiling panel. The present invention provides an adjustable mounting bracket that attaches a ceiling grid, or other ceiling system, to a perimeter frame that is, in turn, attached to perimeter walls or other perimeter structure. The mounting bracket permits the ceiling grid to be installed at a plurality of vertical positions relative to the perimeter frame so that the particular panel or substrate can be accommodated. The invention provides a mounting bracket that has one portion that attaches to the perimeter frame and a separate portion that attaches to the grid. The grid portion of the mounting bracket is attachable to the frame portion of the mounting bracket in a plurality of positions, each of the positions corresponding to a different vertical position of the gird relative to the perimeter frame.

According to one embodiment, a ceiling system includes a perimeter frame; a grid configured to support a plurality of substrates; and a plurality of bracket assemblies coupling the grid to the perimeter frame, the plurality of bracket assemblies adjustable between a plurality of states in which the grid is supported at a different height relative to the perimeter frame in each of the plurality of states.

Some embodiments include the plurality of substrates, the plurality of substrates being supported by the grid.

In some embodiments, when the plurality of bracket assemblies are in each of the plurality of states, the plurality of substrates are supported in a substantially horizontal plane.

In some embodiments, each of the plurality of bracket assemblies includes a frame bracket coupled to the perimeter frame; and a grid bracket, the grid bracket comprising a first portion coupled to the frame bracket and a second portion coupled to the grid, the first portion of the grid bracket configured to be coupled to the frame bracket at a selected one of a plurality of different positions relative to the frame bracket, wherein each of the plurality of different positions corresponds to one of the plurality of states of the bracket assembly.

In some embodiments, for each of the plurality of bracket assemblies, the first portion of the grid bracket comprises a first plate and the second portion of the grid bracket comprises a second plate arranged substantially orthogonal to the first plate.

In some embodiments, for each of the plurality of bracket assemblies, the first plate extends along a longitudinal axis from a first end to a second end, the second plate of the grid bracket comprises a grid mounting section extending from the first plate adjacent the first end of the first plate.

In some embodiments, the grid bracket is configured to be mounted to the frame bracket in a selected one of: (1) a first arrangement in which the first end of the first plate is facing downward; and (2) a second arrangement in which the second end of the first plate is facing downward.

In some embodiments, for each of the plurality of bracket assemblies, the frame bracket comprises a guide element that contacts the grid bracket to maintain relative orientation between the frame bracket and the grid bracket.

In some embodiments, for each of the plurality of bracket assemblies, the first portion of the grid bracket comprises an elongated slot; and wherein each of the plurality of bracket assemblies comprises a threaded fastener extending through the elongated slot and threadily engaging the frame bracket, the threaded fastener alterable between: (1) a free state in which the grid bracket can be moved relative to the frame bracket between the plurality of different positions; and (2) a locked state in which the grid bracket is fixed relative to the frame bracket in the selected one of the plurality of different positions.

In some embodiments, for each of the plurality of bracket assemblies, the elongated slot comprises an undulating edge that forms a plurality of nesting regions for receiving a widened portion of the threaded fastener, and wherein when the widened portion of the threaded fastener is in a selected one of the nesting regions, the undulating edge prohibits relative translation between grid bracket and the frame bracket.

In some embodiments, for each of the plurality of bracket assemblies, the grid bracket can be coupled to the frame bracket at the plurality of different positions incrementally.

In some embodiments, the second portion of the grid bracket comprises a grid mounting section and a tab section, the tab section separated from the grid mounting section by a pre-weakened line so as to be alterable from: (1) a first one of the plurality of states in which the tab section is coupled to the grid mounting section and the grid is supported at a first height relative to the perimeter frame; and (2) a second one of the plurality of states in which the tab section is removed from the grid mounting section and the grid is supported at a second height relative to the perimeter frame, the second height being different than the first height.

In some embodiments, the perimeter frame has a plurality of engagement portions, and each of the bracket assemblies has a first engaging portion that engages a first one of the engagement portions, and a second engaging portion that engages a second one of the engagement portions, such that the bracket assembly is positionally fixed relative to the perimeter frame by the engagement of the first and second engaging portions with the first and second engagement portions.

In some embodiments, the second engaging portion of the bracket assembly is movable relative to the first engaging portion of the bracket assembly.

In some embodiments, for each of the plurality of bracket assemblies, the frame bracket comprises a sliding portion that is movable relative to a main portion of the frame bracket, the sliding portion having a guide element that contacts the main portion of the frame bracket to maintain relative orientation between the sliding portion and the main portion of the frame bracket.

In some embodiments, the second engaging portion of the bracket assembly is fixed to the sliding portion of the frame bracket.

In some embodiments, the perimeter frame is symmetrical about a horizontal plane when the perimeter frame is in an installed position.

In some embodiments, each of the plurality of bracket assemblies includes a frame bracket having a first portion coupled to the perimeter frame and a second portion coupled to the grid, wherein the second portion comprises a grid mounting section and a tab section, the tab section being separated from the grid mounting section by a pre-weakened line so as to be alterable from: (1) a first one of the plurality of states in which the tab section is coupled to the grid mounting section and the grid is supported at a first height relative to the perimeter frame; and (2) a second one of the plurality of states in which the tab section is removed from the grid mounting section and the grid is supported at a second height relative to the perimeter frame, the second height being different than the first height.

In some embodiments, the second portion of the frame bracket is arranged substantially orthogonal to the first portion of the frame bracket.

In some embodiments, the pre-weakened line is in a substantially horizontal plane.

In some embodiments, the second portion of the frame bracket is vertically offset relative to a vertical center point of the first portion of the frame bracket.

According to another embodiment, a bracket assembly for use with a ceiling system having a perimeter frame and a grid that supports a plurality of substrates, includes a frame bracket configured to be coupled to the perimeter frame; and a grid bracket, the grid bracket comprising a first portion coupled to the frame bracket and a second portion configured to be coupled to the grid, the first portion of the grid bracket being configured to be coupled to the frame bracket at a selected one of a plurality of different positions relative to the frame bracket such that the grid is supportable at a different height relative to the perimeter frame in each of the plurality of different positions.

According to yet another embodiment, a bracket assembly for use with a ceiling system having a perimeter frame and a grid that supports a plurality of substrates, includes a frame bracket having a first portion configured to be coupled to the perimeter frame, and a second portion configured to be coupled to the grid. The second portion comprises a grid mounting section and a tab section, the tab section being separated from the grid mounting section by a pre-weakened line so as to be alterable from: (1) a first state in which the tab section is coupled to the grid mounting section and the grid is supportable at a first height relative to the perimeter frame; and a second state in which the tab section is removed from the grid mounting section and the grid is supportable at a second height relative to the perimeter frame, the second height being different than the first height.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
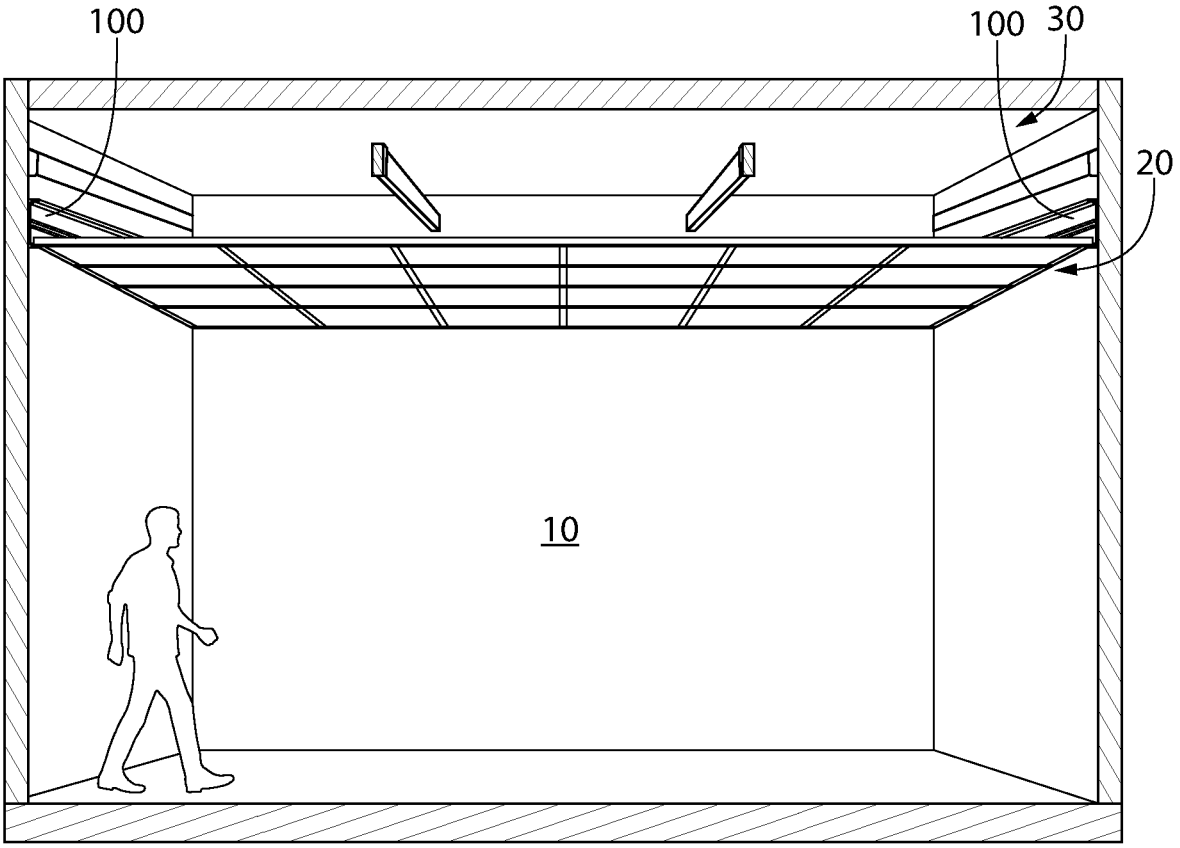
FIG. 1 is a side cross-section view of a plurality of ceiling structures suspended in an interior space to form a ceiling system.

The following description of embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise.

FIG. 1 illustrates a ceiling system 20 that spans from wall to wall to separate a building occupied space 10 from a plenum space 30. In this example, ceiling system 20 is a grid system that includes a number of intersecting rails that support a number of panels or substrates. The rails are attached at their wall ends to a perimeter frame 100. The grid may or may not be additionally supported by wires, cables, tie rods, hangers, struts, or the like at positions remote from the walls of the building occupied space.

Figure 2:
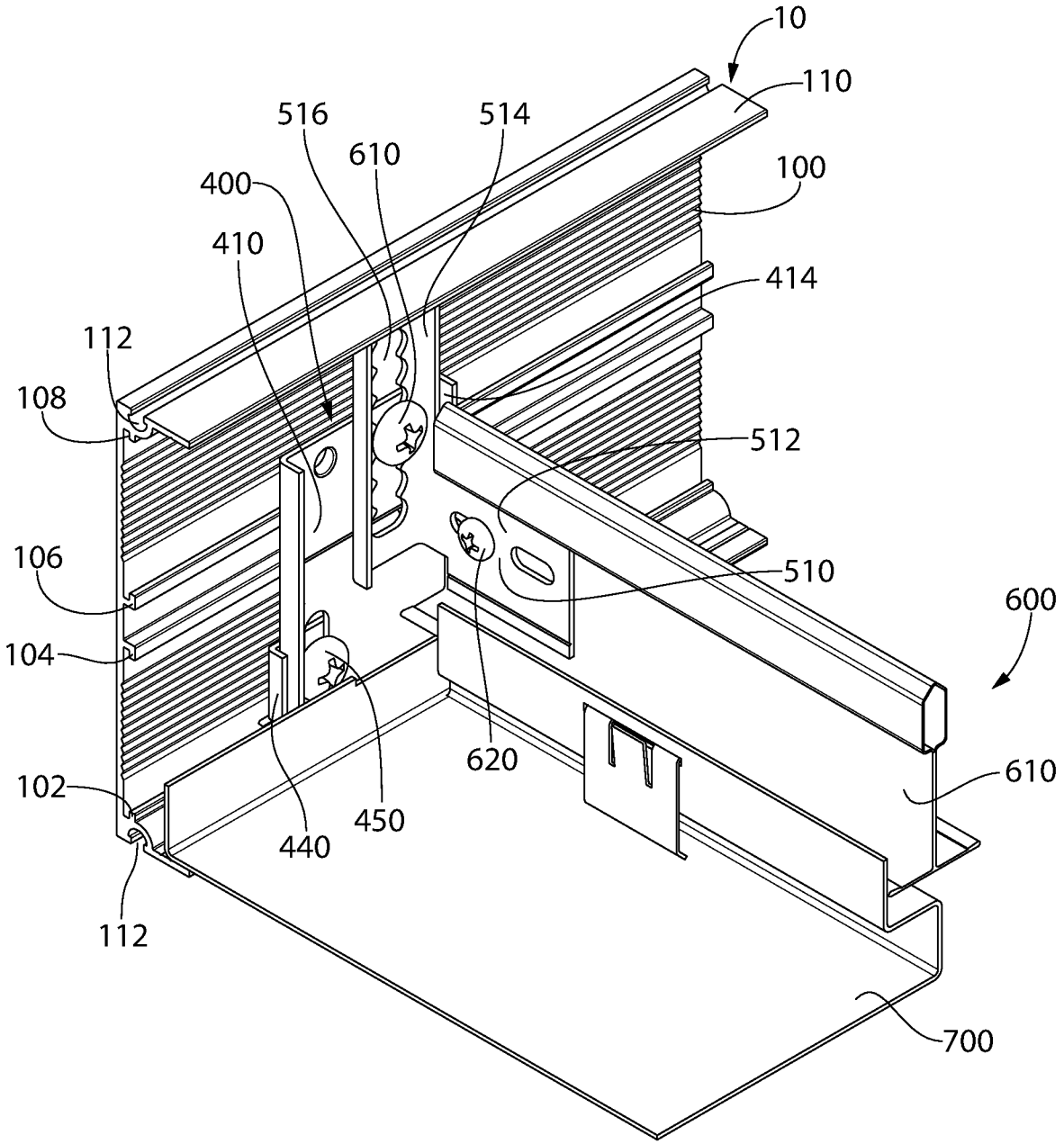
FIG. 2 is a perspective view of perimeter frame, three-piece mounting bracket, and ceiling grid.

FIG. 2 shows an example of ceiling system 10 that includes a bracket assembly 400 mounted in position on a perimeter frame 100 and holding a grid member 600 in position. Also shown is a portion of a substrate, or ceiling panel, 700 that is connected to and/or supported by grid member 600. In this example grid member 600 is a rail 610 that is part of a grid system that supports a plurality of substrates 700. Perimeter frame 100 can be attached to a perimeter, or other, wall that encloses a building space. In a rectangular room, for example, perimeter frame 100 would be attached to each wall to form a rectangular perimeter of the ceiling grid. Perimeter frame 100 can also be attached to walls that are located inside, or project into, the building space in order to support grid members at their ends. In some embodiments perimeter frame 100 provides support for some or all of the weight of the ceiling system. In other embodiments perimeter frame 100 provides only a locating function for the ends of the grid members and provide no structural support of the ceiling system. Support or supplemental support for the ceiling system can come from wires, cables, tie rods, hangers, struts, or the like.

In this example, perimeter frame 100 is symmetrical with respect to a horizontal plane that bisects perimeter frame 100 at its vertical center. This is useful in that perimeter frame 100 can be installed with either flange 110 facing down. If, for example, one of the flanges 110 gets damaged, that section of perimeter frame 100 can be installed with the damaged flange 110 facing upward where it is not visible to users of the building space. In this example, perimeter frame 100 has four engagement portions, or recesses, 102, 104, 106, 108 for receiving bracket assembly 400. Perimeter frame 100 can have more or fewer engagement portions and can also include other recesses, attachment points, holes, etc., for facilitating attachment of other elements to perimeter frame 100 or for attaching perimeter frame 100 to a wall or other structure. For example, in FIG. 2, perimeter frame 100 has a fabric attachment recess 112 on each of its flanges 110. These feature can also be seen in FIG. 3.

Figure 3:
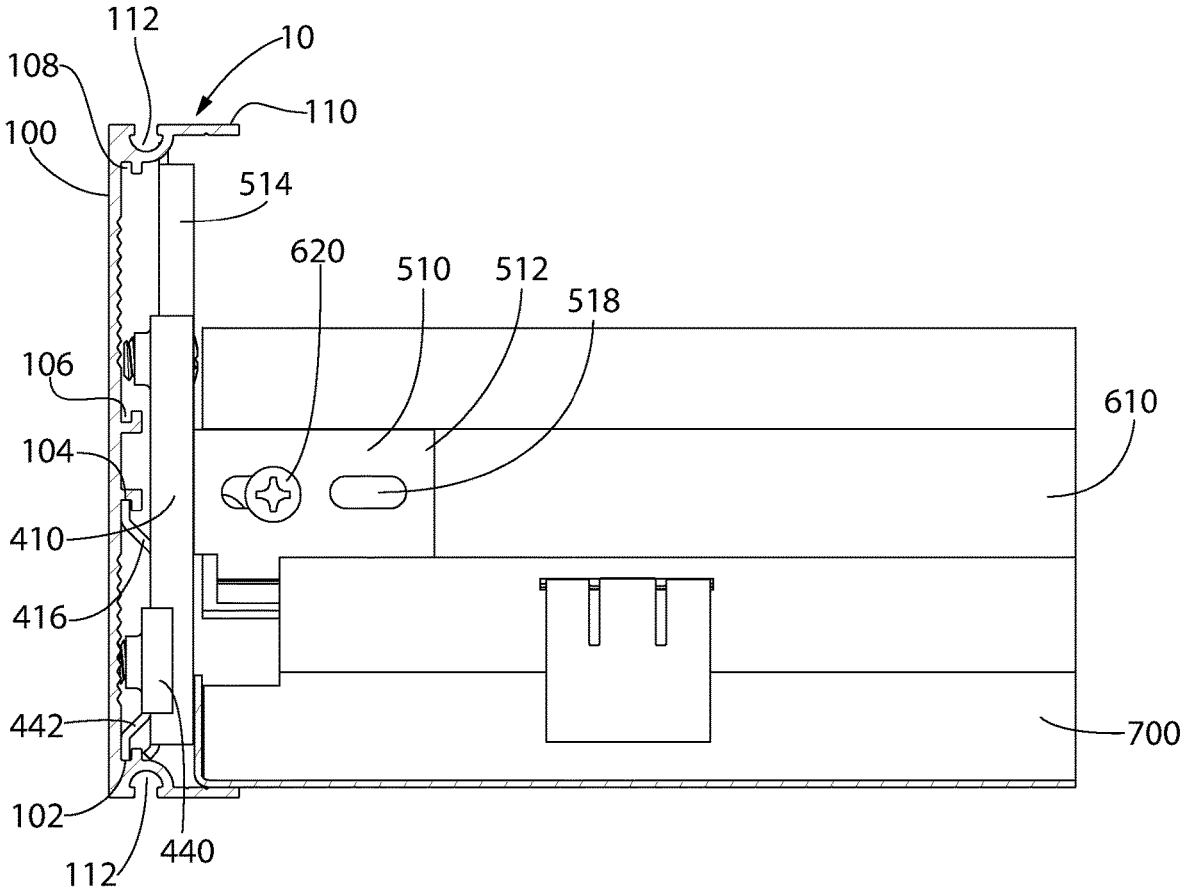
FIG. 3 is a side view of the structure shown in FIG. 2.
Figure 4:
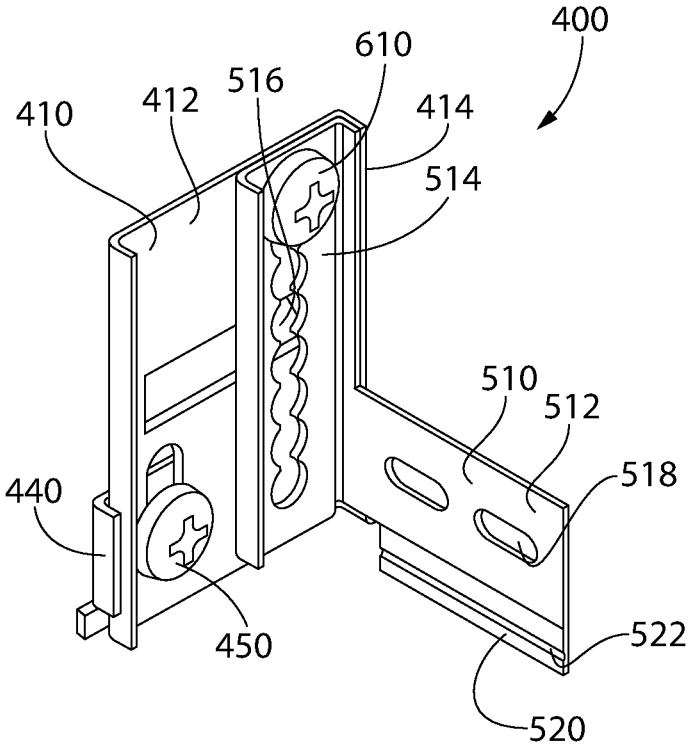
FIG. 4 is a perspective view of a three-piece mounting bracket.

The bracket assembly 400 shown in FIGS. 2-8 is a three-part bracket assembly. Bracket assembly 400 has a grid bracket 510 that attaches to grid member 600 and a frame bracket main portion 410 that attaches to perimeter frame 100. Frame bracket main portion 410 is attached to perimeter frame 100 with the help of a frame bracket sliding portion 440 that includes a second engaging portion 442. In this example, second engaging portion 442 is a stamped, bent portion of frame bracket sliding portion 440. In other embodiments, second engaging portion 442 can be a machined lip or other engaging feature. As shown in FIG. 4, frame bracket sliding portion 440 is held to frame bracket main portion 410 with a screw 450 such that frame bracket sliding portion 440 is movable in a vertical direction relative to frame bracket main portion 410. Although a slot and a screw are used in this embodiment, other attachment methods can be used. To attach frame bracket main portion 410 to perimeter frame 100, frame bracket main portion 410 is moved toward perimeter frame 100 such that a first engaging portion 416 engages one of the engagement portions 104, 108 while frame bracket sliding portion 440 (and therefore second engaging portion 442) is held in an upper position. In this example, first engaging portion 416 is a stamped louvered flange. In other embodiments, first engaging portion 416 can be a machined lip or other engaging feature. In this example, first engaging portion 416 engages engagement portion 104. Then frame bracket main portion 410 and frame bracket sliding portion 440 are tilted toward perimeter frame 100 until second engaging portion 442 contacts perimeter frame 100 right above engagement portion 102. Then frame bracket sliding portion 440 is moved downward so that second engaging portion 442 engages engagement portion 102, as shown in FIG. 3. Screw 450 is then tightened to hold frame bracket sliding portion 440 and frame bracket main portion 410 securely in place on perimeter frame 100. In order to keep the proper orientation of frame bracket sliding portion 440 relative to frame bracket main portion 410, frame bracket sliding portion 440 has a guide element that rests against an edge of frame bracket main portion 410 when frame bracket sliding portion 440 is tightened against frame bracket main portion 410. This guiding element helps ensure that second engaging portion 442 is squarely in engagement portion 102.

Now turning to grid bracket 510, FIG. 4 shows that grid bracket 510 has a first portion 514 and a second portion 512 that are, in this example, arranged orthogonally. First portion 514 attaches to grid member 600 with one or more screws 620 though one or more holes 518, or other attachment method. Second portion 514 is attached to frame bracket main portion 410 with a screw 610. As can be seen best in FIGS. 2, 4 and 5, screw 610 extends through a slot 516 in first portion 514 of grid bracket 510. As a result of slot 516, grid bracket 510 can be attached to frame bracket 410 in a plurality of different positions along a vertical axis. It is this adjustability that allows grid member 600 to be attached to perimeter frame 100 in a plurality of different positions.

In the example shown in the Figures, slot 516 has undulating edges that form a plurality of wide spots in slot 516. Each of the wide spots in slot 516 is sized to receive a widened portion of screw 610 so that a particular relative position of frame bracket main portion 410 and grid bracket 510 can be set similarly for all bracket assemblies used in the ceiling system. Setting all of the bracket assemblies at the same position is important to maintain a level ceiling assembly. Although slot 516 has undulating edges in this embodiment, other embodiments have a slot with straight sides, which allows infinite adjustability in the relative positions of frame bracket main portion 410 and grid bracket 510. A slot with straight sides can be advantageous if the installation requires fine adjustments in the relative position of frame bracket main portion 410 and grid bracket 510. The sides and other parts of slot 516 can be any shape that permits screw 610 to hold frame bracket main portion 410 at the desired position relative to grid bracket 510. For example, the sides of slot 516 can have a shape that is in between straight and the undulating example shown in the drawings.

In this embodiment, frame bracket main portion 410 has a flat area 412 that first portion 514 of grid bracket 510 rests against when grid bracket 510 is tightened against frame bracket main portion 410. In order to keep the proper orientation of grid bracket 510 relative to frame bracket main portion 410, frame bracket main portion 410 has a guide element 414 that an edge of first portion 514 of grid bracket 510 rests against when grid bracket 510 is tightened against frame bracket main portion 410. This is best seen in FIG. 4.

Figure 5:
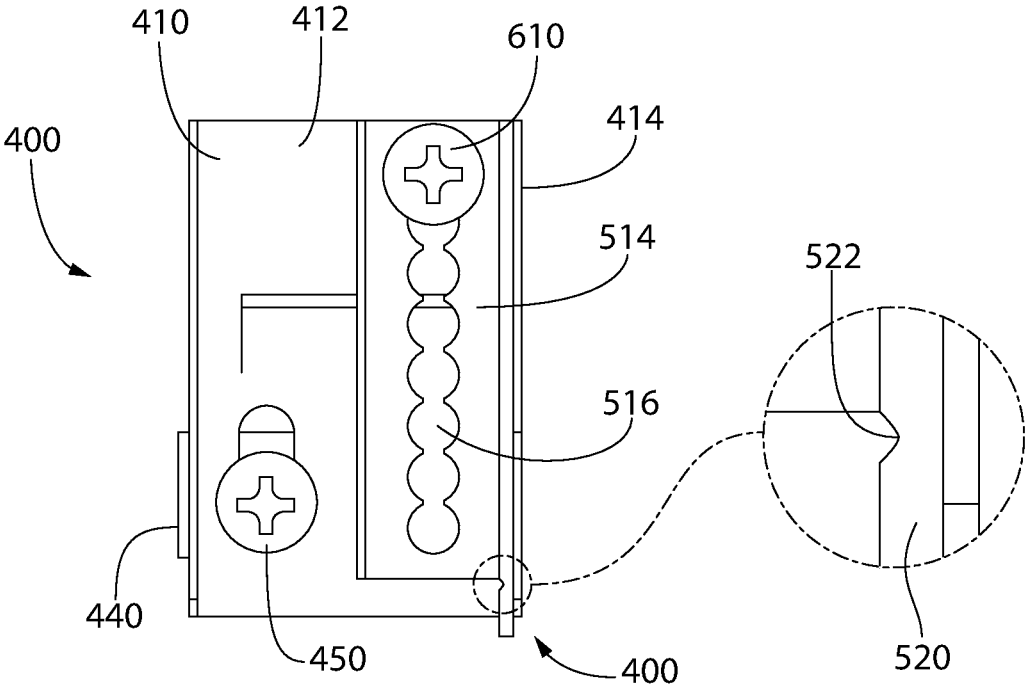
FIG. 5 is a front view of the three-piece mounting bracket shown in FIG. 4.
Figure 6:
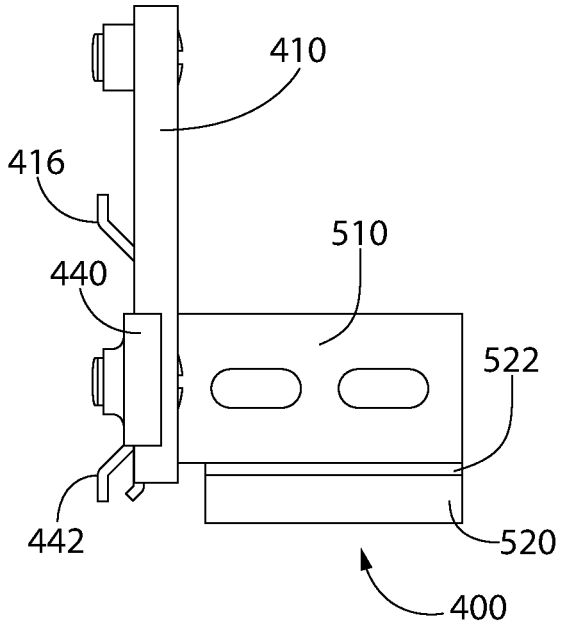
FIG. 6 is a side view of the three-piece mounting bracket shown in FIG. 4.

FIGS. 4 and 5 show second portion 512 of grid bracket 510 having a weakened portion 522 that separates a tab 520 from the remainder of second portion 512. FIG. 6 shows an alternate size of tab 520. The purpose of weakened portion 522 is to make tab 520 easily separable from the remainder of second portion 512. This will be discussed further below.

Figure 7:
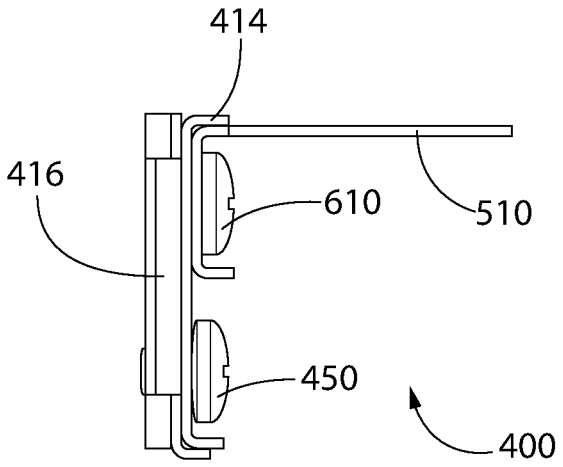
FIG. 7 is a top view of the three-piece mounting bracket shown in FIG. 4.
Figure 8:
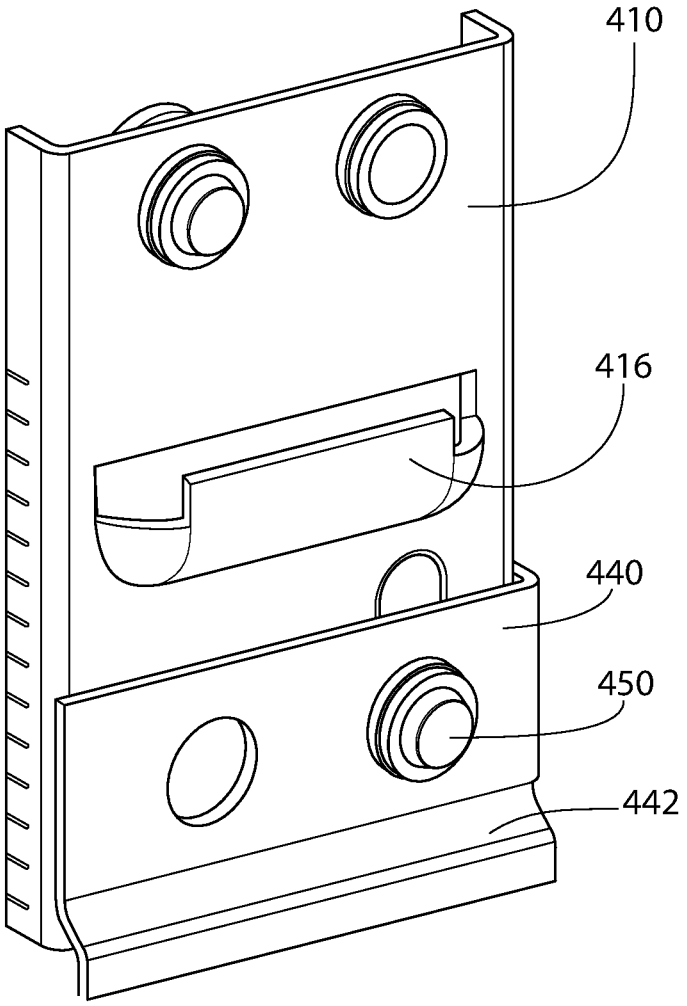
FIG. 8 is a perspective view of a part of the three-piece mounting bracket shown in FIG. 4.

FIG. 5 shows a front view of bracket assembly 400, FIG. 6 shows a side view, and FIG. 7 shows a top view.

Figure 9:
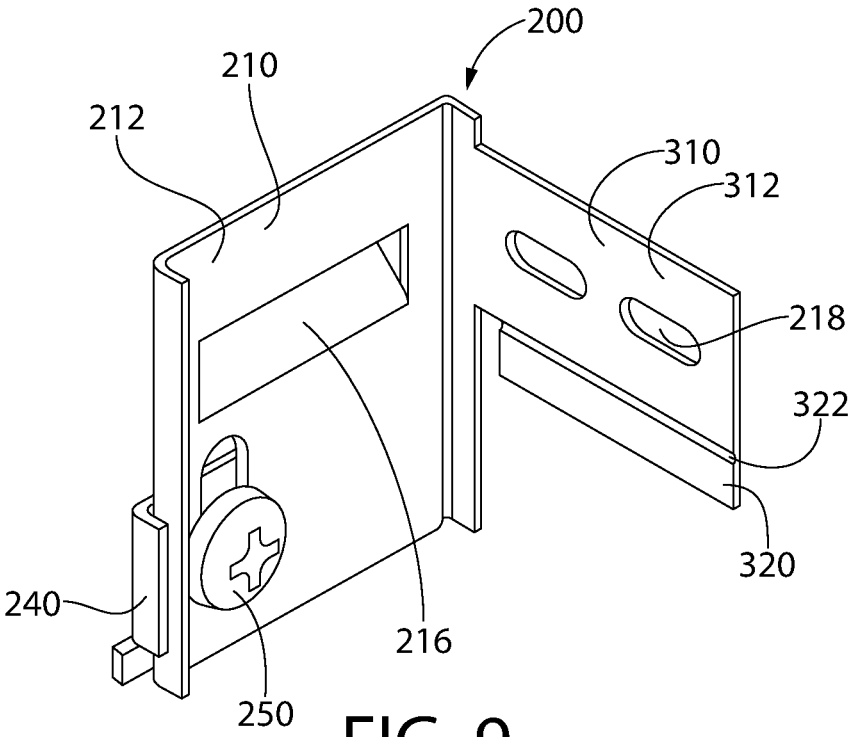
FIG. 9 is a perspective view of a two-piece mounting bracket.
Figure 10:
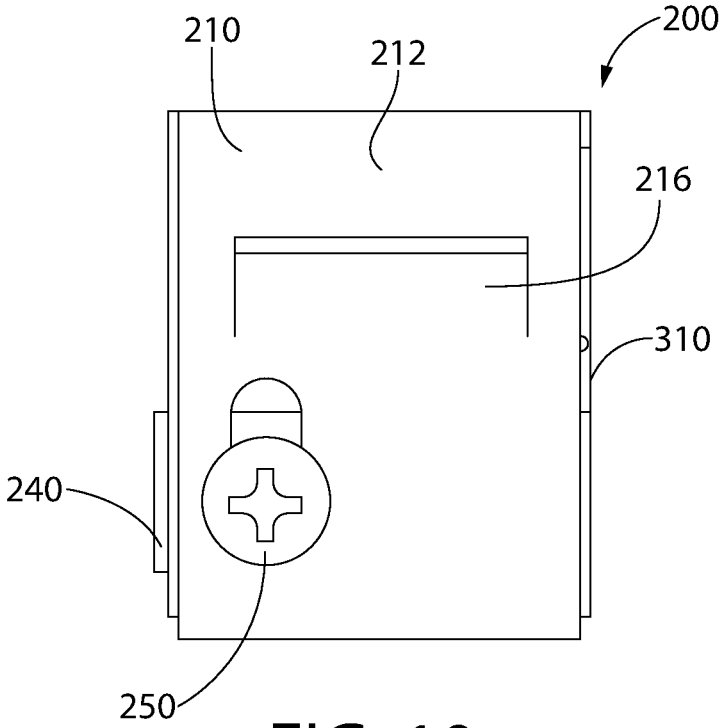
FIG. 10 is a front view of the two-piece mounting bracket shown in FIG. 9.

FIGS. 9-12 show an example of a two-piece bracket assembly 200. Bracket assembly 200 has a first portion 210 that attaches to perimeter frame 100 and second portion 310 that attaches to grid member 600. First portion 210 has a flat portion 212 from which a first engaging portion 216 extends. First portion 210 is attached to perimeter frame 100 with the help of a bracket sliding portion 240 that includes a second engaging portion 242. As shown in FIG. 9, bracket sliding portion 240 is held to first portion 210 with a screw 250 such that bracket sliding portion 240 is movable in a vertical direction relative to first portion 210. Although a slot and a screw are used in this embodiment, other attachment methods can be used. Similarly to the example shown in FIGS. 4-8, to attach first portion 210 to perimeter frame 100, first portion 210 is moved toward perimeter frame 100 such that first engaging portion 216 engages a first engagement portion of perimeter frame 100 while bracket sliding portion 240 is held in an upper position. Then first portion 210 and bracket sliding portion 240 are tilted toward perimeter frame 100 until second engaging portion 242 contacts perimeter frame 100 right above a second engagement portion. Then bracket sliding portion 240 (and therefore second engaging portion 242) is moved downward so that second engaging portion 242 engages the second engagement portion, similarly to what is shown in FIG. 3. Screw 250 is then tightened to hold bracket sliding portion 240 and first portion 210 securely in place on perimeter frame 100. In this example, first engaging portion 216 is a stamped louvered flange. In other embodiments, first engaging portion 216 can be a machined lip or other engaging feature. In this example, second engaging portion 242 is a stamped, bent portion of bracket sliding portion 240. In other embodiments, second engaging portion 242 can be a machined lip or other engaging feature. In order to keep the proper orientation of bracket sliding portion 240 relative to first portion 210, bracket sliding portion 240 has a guide element that rests against an edge of first portion 210 when bracket sliding portion 240 is tightened against first portion 210. This guiding element helps ensure that second engaging portion 242 is squarely in the second engagement portion.

Figure 11:
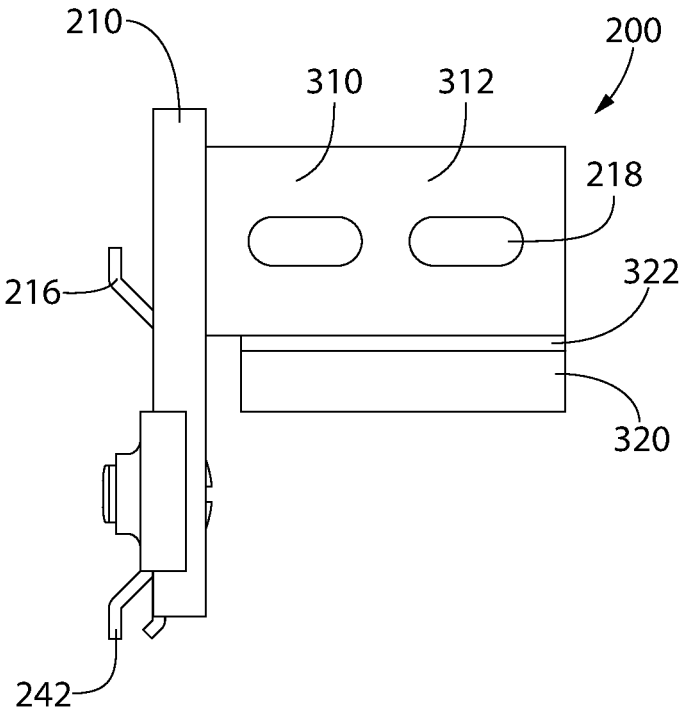
FIG. 11 is a side view of the two-piece mounting bracket shown in FIG. 9.
Figure 12:
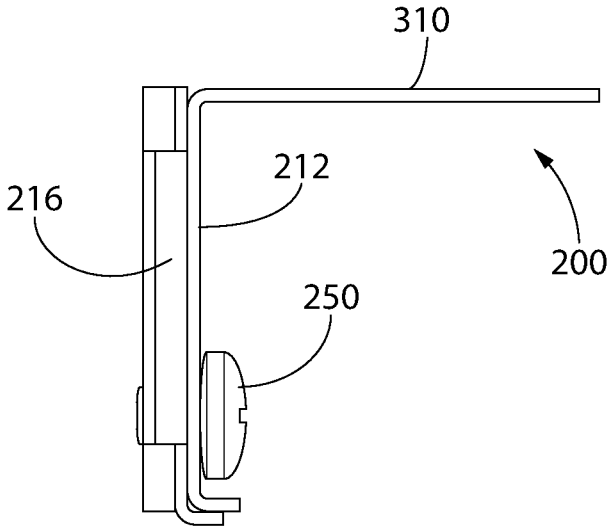
FIG. 12 is a top view of the two-piece mounting bracket shown in FIG. 9.

FIG. 11 shows that second portion 310 and first portion 210 are, in this example, arranged orthogonally. A grid mounting section 312 of second portion 310 attaches to grid member 600 with one or more screws though one or more holes 218, or other attachment method.

Figure 13:
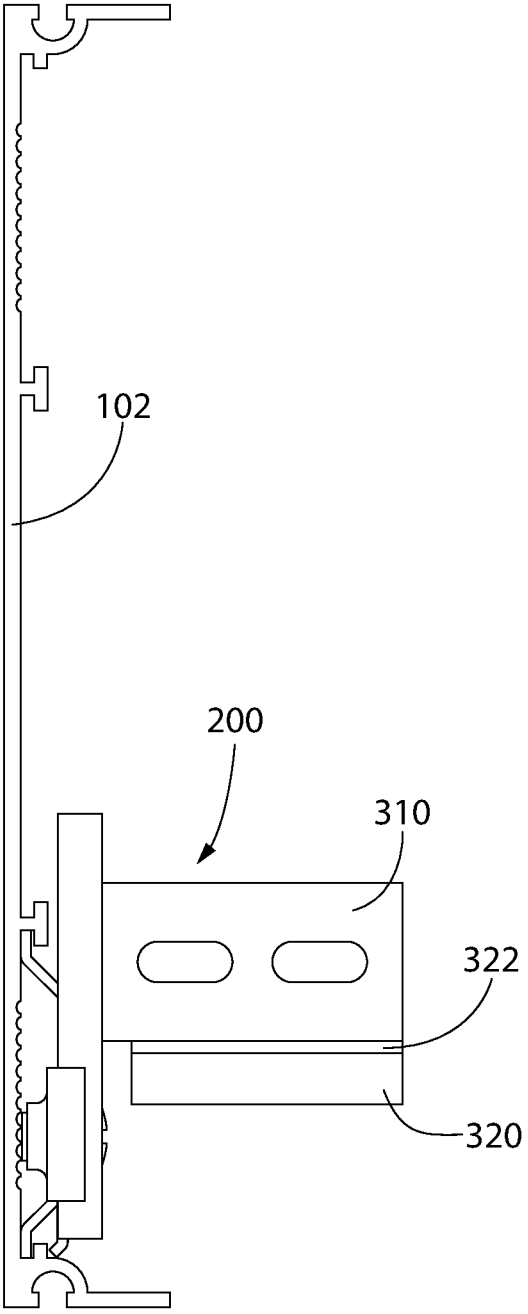
FIG. 13 is a side view of a mounting bracket attached to a perimeter frame of a first size.
Figure 14:
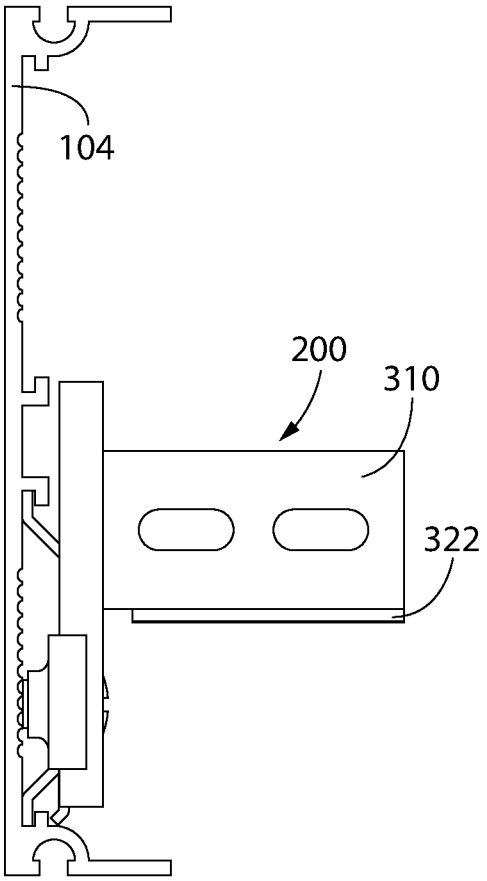
FIG. 14 is a side view of a mounting bracket attached to a perimeter frame of a second size.

As shown in FIGS. 9 and 11, second portion 310 of bracket assembly 200 has a weakened portion 322 that separates a tab 320 from the remainder of second portion 310. The purpose of weakened portion 322 is to make tab 320 easily separable from the remainder of second portion 310. Weakened portion 322 allows bracket assembly 200 to be altered between a first state in which tab 320 is in place and the grid is supported at a first height relative to the perimeter frame, and a second state in which tab 320 is removed and the grid is supported at a second height relative to the perimeter frame, the second height being different than the first height. FIG. 13 shows bracket assembly 200, with tab 320 intact, attached to a perimeter frame 102. FIG. 14 shows bracket assembly 200, with tab 320 removed, attached to a perimeter frame 104. As can be seen from FIGS. 13 and 14, removal of tab 320 creates a greater distance between the bottom of second portion 310 and the lower flange of the perimeter frame. The greater distance can allow the grid member to be mounted higher relative to the perimeter frame. By removing tab 320, bracket assembly 200 can also be attached to grid members having a shorter vertical space available to receive second portion 310.

Figure 15:
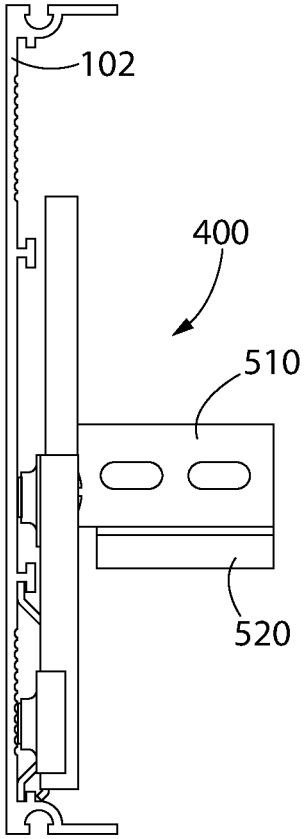
FIG. 15 is a side view of a three-piece mounting bracket attached to a perimeter frame in a first position.
Figure 16:
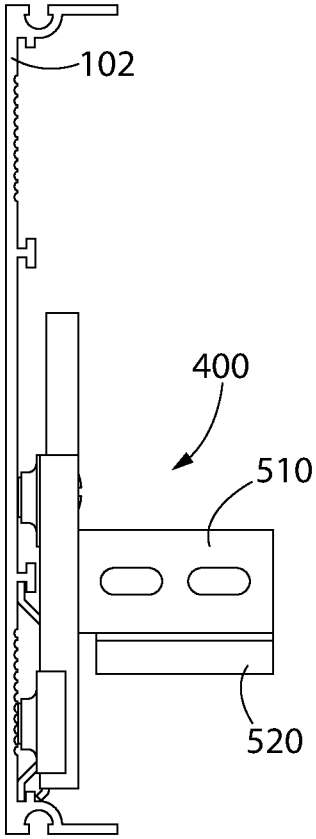
FIG. 16 is a side view of a three-piece mounting bracket attached to a perimeter frame in a second position.
Figure 17:
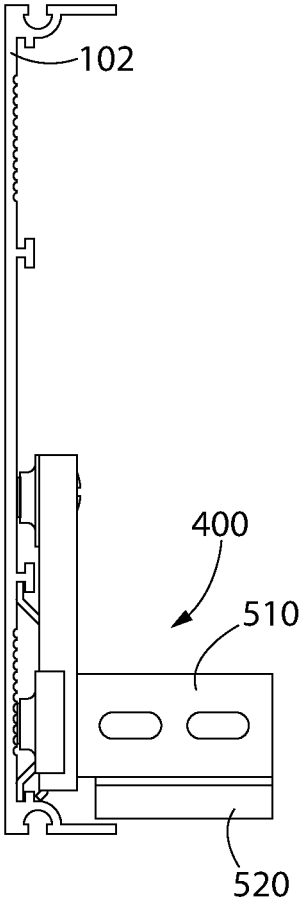
FIG. 17 is a side view of a three-piece mounting bracket attached to a perimeter frame in a third position.

FIGS. 15-18 show some of the possible arrangements of three-piece bracket assembly 400 attached to perimeter frame 102. These arrangements differ only in the position of grid bracket 510 relative to frame bracket 410. FIG. 15 shows grid bracket 510 in the highest position with tab 520 pointing downward. FIG. 17 shows grid bracket 510 in the lowest position with tab 520 pointing downward. FIG. 16 shows grid bracket 510 in an intermediate position with tab 520 pointing downward. Although three positions are shown in FIGS. 15-17, grid bracket 510 can be in other positions in between those shown in FIGS. 15 and 17. The number of available positions is determined by the shape and length of slot 516. A longer slot 516 will provide more positions and a smooth slot, as opposed to a slot with undulating edges, will provide infinite adjustability.

Figure 18:
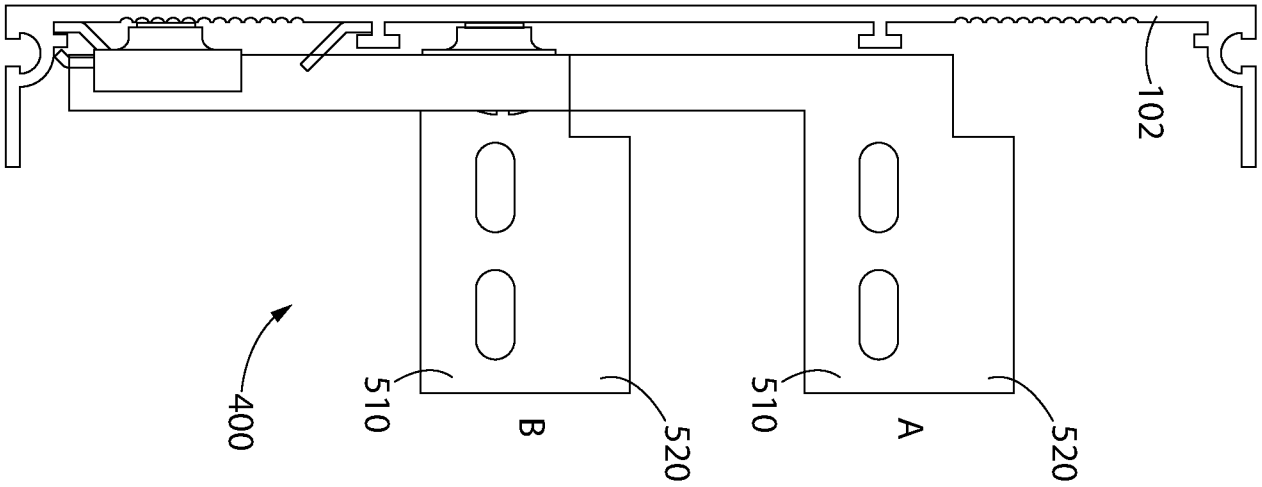
FIG. 18 is a side view of a three-piece mounting bracket attached to a perimeter frame in two different positions.

FIG. 18 shows two different arrangements in which grid bracket 510 is mounted such that tab 520 is pointing upward. In these positions, grid bracket 510 is mounted upside down as compared to the orientation in FIGS. 2-7 and 15-17. Mounting grid bracket 510 such that tab 520 is pointing upward provides an additional range of mounting positions of the grid member. Positions A and B shown in FIG. 18 are just two of the positions possible.

Similarly to tab 320 described above, tab 520 can be removed to provide even more possible mounting positions of the grid member. Given a slot 516 having 8 positions for screw 610 (as shown in FIG. 5), sixteen installation heights are possible with tab 520 pointing down, eight with the tab intact and eight with the tab removed. For example, if there are eight screw positions (undulations in slot 516), they are ¼" apart, and tab 520 is ⅛" tall, there will be sixteen positions ⅛" apart. Up to another eight positions can be available with tab 520 pointing upward.

What is claimed is:

1. A bracket assembly for a ceiling system, the bracket assembly comprising:

a first bracket comprising a first plate with a first hole;

a second bracket comprising a second plate having an elongated slot and an elongated arm extending outwardly therefrom, the elongated arm configured to be coupled to a grid; and a first fastener extending through the slot and fixedly coupled to the first plate to slideably couple the first and second plates together;

wherein the first plate of the first bracket includes a perpendicularly oriented guide flange arranged to engage an edge of the second plate of the second bracket; and wherein the elongated arm comprises a substantially planar body, and the elongated arm includes a weakened portion separating a tab from other portions of the elongated arm.

2. The bracket assembly according to claim 1, wherein the first fastener can be tightened to lock the second plate in one of a plurality of locked positions in the slot.

3. The bracket assembly according to claim 1, wherein the first and second plates are substantially planar.

4. The bracket assembly according to claim 3, wherein the second plate abuttingly engages the first plate of the first bracket.

5. The bracket assembly according to claim 1, wherein the second plate is elongated having a greater length than width.

6. The bracket assembly according to claim 1, wherein the elongated arm is oriented perpendicularly to the second plate of the second bracket.

7. The bracket assembly according to claim 6, wherein the elongated arm comprises at least one elongated grid mounting slot.

8. A bracket assembly for a ceiling system, the bracket assembly comprising:

a first bracket comprising a first plate with a first hole;

a second bracket comprising a second plate having an elongated slot and an elongated arm extending outwardly therefrom, the elongated arm configured to be coupled to a grid; and a first fastener extending through the slot and fixedly coupled to the first plate to slideably couple the first and second plates together;

wherein the slot of the second plate comprises opposing undulating edges forming a plurality of wide spots defining a plurality of discrete fastening positions.

9. The bracket assembly according to claim 1, wherein the slot of the second plate comprises opposing straight edges forming a plurality of fastening positions.

10. The bracket assembly according to claim 8, wherein the first fastener can be tightened to lock the second plate in one of a plurality of locked positions in the slot.

11. The bracket assembly according to claim 8, wherein the first and second plates are substantially planar and the second plate abuttingly engages the first plate of the first bracket.

12. The bracket assembly according to claim 8, wherein the elongated arm is oriented perpendicularly to the second plate of the second bracket.

13. The bracket assembly according to claim 12, wherein the elongated arm comprises a substantially planar body and the elongated arm includes a weakened portion separating a tab from other portions of the elongated arm.

14. The bracket assembly according to claim 12, wherein the elongated arm comprises at least one elongated grid mounting slot.

15. A bracket assembly for a ceiling system, the bracket assembly comprising:

a first bracket comprising a first plate with a first hole and a first elongated slot;

a second bracket comprising a second plate having a second elongated slot and an elongated arm extending outwardly therefrom, the elongated arm configured to be coupled to a grid; and a first fastener extending through the second elongated slot and fixedly coupled to the first plate to slideably couple the first and second plates together;

a third plate with a second hole; and a second fastener extending through the first elongated slot and fixedly coupled to the third plate to slideably couple the first and third plates together;

wherein the first plate includes a first angled mounting protrusion fixed in position on the first plate, and the third plate includes a second angled mounting protrusion spaced apart by a separation distance from the first angled mounting protrusion, the separation distance being adjustable via sliding the third plate relative to the first plate.

16. The bracket assembly according to claim 15, wherein the second fastener can be loosened to slide the third plate between a plurality of mounting positions, and the second fastener can be tightened to lock the third plate in one of the mounting positions.

17. A bracket assembly for a ceiling system, the bracket assembly comprising:

a first bracket comprising a substantially planar main body and a first angled engaging protrusion configured to engage a ceiling support structure;

a second bracket slideably coupled to the first bracket by a first fastener, the second bracket adjustable relative to the first bracket between a plurality of linear mounting positions;

a third bracket having an elongated first portion comprising an elongated second slot and an elongated second portion extending perpendicularly to the first portion; and a second fastener extending through the second slot in the first portion and engaged with a first circular hole in the first bracket to couple the first and third brackets together;

the second bracket comprising a second angled engaging protrusion configured to engage the ceiling support structure;

the second angled engaging protrusion being spaced apart from the first angled engaging protrusion by a separation distance which is adjustable via sliding the second bracket relative to the first bracket; and wherein the first fastener is received through an elongated first slot formed in the first bracket and a second circular hole formed in the second bracket; and wherein the first portion of the third bracket is adjustable in a plurality of fastening positions relative to the first bracket via the second slot.

18. The bracket assembly according to claim 17, wherein the second fastener can be: (1) tightened to lock the third bracket in one of a plurality of fastening positions; or (2) loosened to slideably adjust the third bracket relative to the first bracket.

* * * * *